US006710272B2

(12) United States Patent
Tsuji

(10) Patent No.: US 6,710,272 B2
(45) Date of Patent: Mar. 23, 2004

(54) KEY SWITCH

(75) Inventor: Akihiro Tsuji, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 10/037,089

(22) Filed: Nov. 9, 2001

(65) Prior Publication Data

US 2002/0056613 A1 May 16, 2002

(30) Foreign Application Priority Data

Nov. 13, 2000 (JP) ..... 2000-345331

(51) Int. Cl.[7] ..... H01H 1/22

(52) U.S. Cl. ..... 200/244; 200/241

(58) Field of Search ..... 200/313, 314, 200/341–345, 512–517, 5 A, 317, 310

(56) References Cited

U.S. PATENT DOCUMENTS 6,084,190 A * 7/2000 Kenmochi ..... 200/310

* cited by examiner

*Primary Examiner*—Lincoln Donovan
*Assistant Examiner*—M. Fishman
(74) *Attorney, Agent, or Firm*—McGlew and Tuttle, P.C.

(57) ABSTRACT

A key switch wherein a key top 1 made of thermoplastic resin and a extruding part 2 made of thermoplastic elastomer are integrally formed, thereby improving clicking touch of a contact member, such as a metal belleville spring, a resin film dome or the like, which is placed underneath the extruding part and preventing breakage and laceration of the contact member. Further, a key switch is constructed such that extruding parts 2 of a plurality of key tops 1 are integrally linked by means of a U-shaped bridging member 3 made of thermoplastic elastomer, thereby causing elastic deformation of the bridging member 3 at the time of pressing one of the plurality of key tops 1 so that an extruding part 2 of an adjacent key top is prevented from operating together.

6 Claims, 2 Drawing Sheets

KEY SWITCH

BACKGROUND OF THE INVENTION

1. Technical Field of the Invention

The present invention relates to a key switch pressing a contact which is built into an input part of switch provided in equipment such as a telephone, a mobile communications device, an acoustic instrument, remote controls and an on-vehicle device.

2. Related Art

A push button switch of the telephone or the like is comprised of a key top which the operator touches with a finger at the time of pressing the push button switch and an extruding part (or push stud) pushing a contact member.

As a material of the key top, a rigid resin which has a good feeling of touch and is easy to push is preferably used, and a great variety of key tops may be designed.

The contact member, such as a metal belleville spring with clicking touch, a resin film dome or the like, is placed underneath the extruding part.

FIG. 5 shows an example of conventional push button switches having key tops made of rigid resin. In this case, the key tops 5 made of thermoplastic resin are firmly fixed to keypads 7 made of silicone rubber having extruding parts 6 via adhesives 8. FIG. 6 shows another example of conventional push button switches wherein key tops 5 made of thermoplastic resin having integrally shaped extruding parts 6 are firmly fixed by means of a resin film 9.

In conjunction with miniaturization of telephones, portable terminals or the like, there is a growing demand for reduction in size of push button switches. However, in the former conventional push button switch, because the key tops are one by one fixed to the keypads by means of the adhesives, the manufacture of such a push button switch requires much time and trouble, which resulting in the difficulty in the miniaturization thereof.

On the other hand, in the latter conventional push button switch, the extruding parts are also made of resin with a high rigidity. For this reason, in case where the contact member is a metal belleville spring, a pressing load at the time of clicking is heavy, and the load is applied to a substrate placed underneath the metal belleville spring, which results in the occurrence of dent marks on the surface of the substrate. Further, in case where the contact member is a resin film dome, the load is applied to the dome, thereby causing the decrease of the clicking touch of the contact member and the crack of the contact member due to the concentration of residual stress. Moreover, there has been a problem in that in case of linking a plurality of key tops, adjacent key tops are operated together when one of the key tops is pressed.

SUMMARY OF THE INVENTION

For the purpose of solving the above-mentioned problems, the present invention provides a key switch in which by forming an extruding part by elastic material different from a rigid resin of a key top, the clicking touch of a contact member may be improved, and breakage and laceration of the contact member may be prevented, and further miniaturization of a push button switch may be facilitated.

More specifically, a key top made of thermoplastic resin and an extruding part made of thermoplastic elastomer are integrated into one body. Preferably, a plurality of key tops are connected by integrating their extruding parts by means of a bridging member. Further preferably, a decorative layer composed of a paint coating or a metal coating is formed on the surface of a key top.

DETAILED DESCRIPTION OF THE PREFERRED EMBODIMENT

Figure 1:
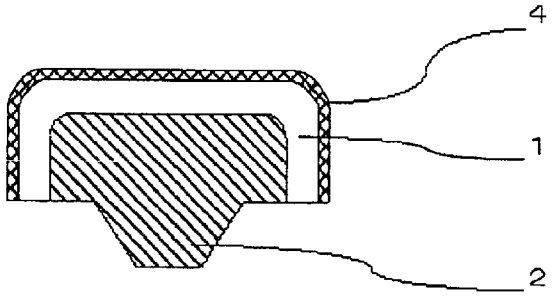
FIG. 1 is a longitudinal sectional view of an embodiment of the present invention.

As shown in FIG. 1, the present invention is directed to a key switch in which a key top 1 made of thermoplastic resin and an extruding part 2 made of thermoplastic elastomer different from the material of the key top 1 are integrated into one body, and a decorative layer 4 comprised of a paint coating or a metal coating is formed on the surface of the key top 1.

Underneath the extruding part 2, there is provided a contact member such as a metal belleville spring, a resin film dome or the like. By forming the extruding part 2 with a resilient thermoplastic elastomer, as described above, it is possible to improve clicking touch of the contact member and prevent its breakage and laceration.

Figure 2:
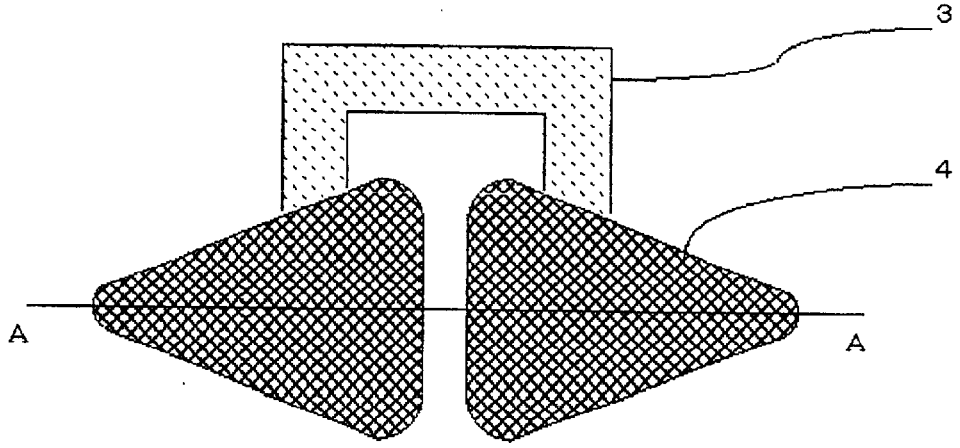
FIG. 2 is a top view of an embodiment of the present invention.
Figure 3:
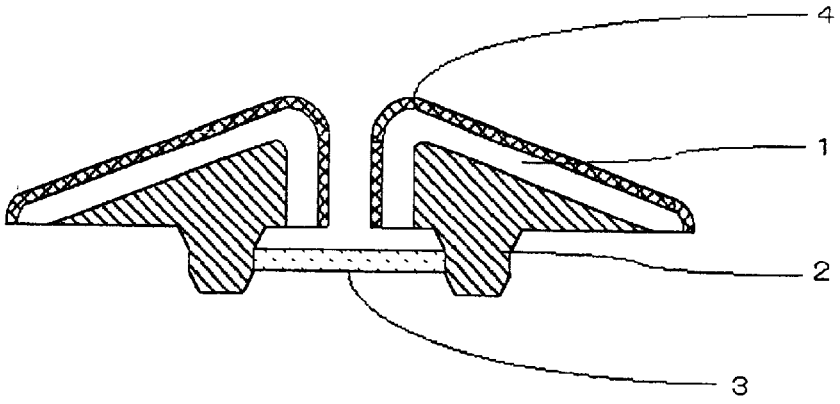
FIG. 3 is a cross sectional view taken along line A—A of FIG. 2.

Moreover, FIGS. 2 and 3 show a key switch constructed such that extruding parts 2 of a plurality of key switches are integrally connected by means of a U-shaped bridging member 3 made of thermoplastic elastomer.

This construction causes the bridging member 3 to deform elastically when one of the plurality key switches is pressed, which prevents the extruding part 2 of the other adjacent key top 1 from operating together, thereby allowing an accurate switch operation. The back of the bridging member 3 is served as a portion to be attached to a housing or the like.

Thermoplastic resin used for the key top of the present invention is composed of paint coating formed by means of various printing or painting, or metal coating formed by means of plating or vapor deposition. Therefore, in case of selecting a resin that can be treated by secondary processing such as printing, painting, plating, vapor deposition or the like, a great variety of decoration of the key top can be freely designed.

Thermoplastic elastomer used as material of the extruding part of the present invention is selected from styrene rubber, vinyl chloride rubber, olefin rubber, polyester rubber, polyamide rubber, urethane rubber or the like.

If necessary, moreover, by using a translucent material in formation of the decorative portion of the key top and the extruding part, the key switch can be illuminated from a translucent portion provided in the decorative layer at the time of illuminating from the reverse face.

Here will be described a method of manufacturing the key switch of the present invention.

A key top near the surface of the key switch is formed by injection molding thermoplastic resin with a die for a primary molding. Then, by injection molding thermoplastic elastomer with a die for a secondary molding, an extruding part and a bridging member are integrally united. If necessary, moreover, a decorative layer is formed on the surface of the key top by implementing an optional secondary processing such as printing, painting, plating, vapor deposition or the like.

Embodiment 1

Figure 4:
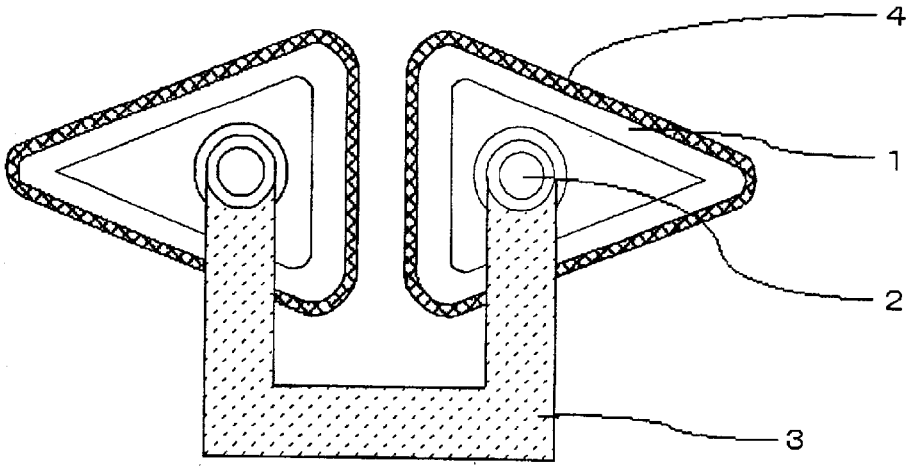
FIG. 4 is a bottom view of an embodiment of the present invention.
Figure 5:
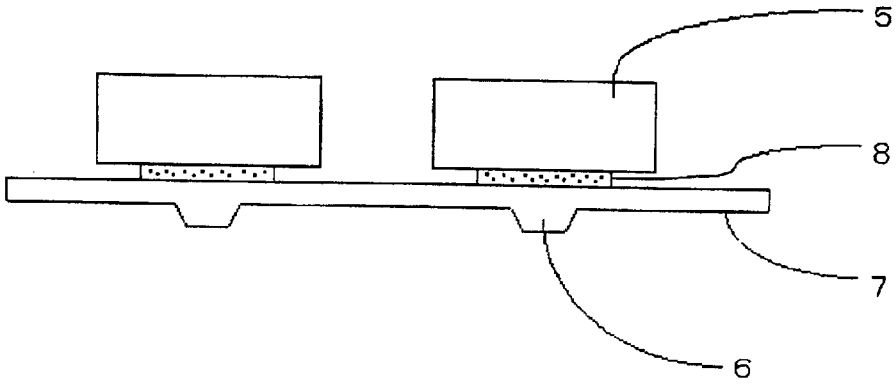
FIG. 5 is a longitudinal sectional view of the conventional push button switch.
Figure 6:
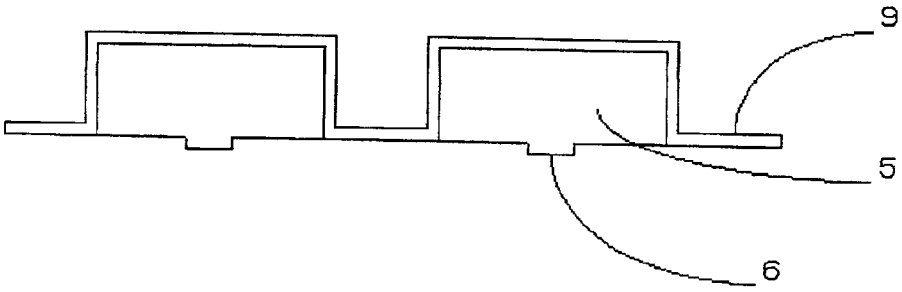
FIG. 6 is a longitudinal sectional view of the conventional push button switch.

The key top 1 is formed by injection molding a platable ABS resin with the die for a primary molding. Then, using the die for a secondary molding, the extruding part 2 and the bridging member 3 are integrally united. After implementing mold clamping by jointing a female die for the primary molding and a male die for the secondary molding together, the extruding part 2 and the bridging member 3 are integrated with the key top 1 by injection molding thermoplastic elastomer urethane. Then, the surface of the key top is plated with hard chromium to form the decorative layer 4. Thus, the key switch of the present invention, as shown in FIGS. 2 to 4, is obtained.

According to the present invention, by forming the extruding part 2 from resilient thermoplastic elastomer, clicking touch of the contact member, such as a metal belleville spring, a resin film dome or the like, which is placed underneath the extruding part can be improved, and breakage and laceration of the contact member can be prevented.

Moreover, by connecting a plurality of key switches by means of thermoplastic elastomer, the bridging member 3 becomes an elastic body. Therefore, when the key switch is pressed, elastic deformation of the bridging member prevents an adjacent key switch from operating together. Also, it becomes possible to built in a large number of key switches in at a time in a state of being connected with one another. Adoption of a multi-cavity mold allows the reduction of production cost and contribution to the improvement of production efficiency at the time of building in a large number of key switches.

The present invention provides a key switch having a rigid surface, a soft clicking touch and an excellent durability. Moreover, according to the present invention, a great variety of key switches can be designed, and secondary processing such as printing, painting, plating, vapor deposition or the like can be carried out easily, and the decoration of push button switches can be freely designed.

What is claimed is:

1. A key switch comprising:

a plurality of key tops made of a thermoplastic resin and arranged in a key plane;

a plurality of extruded parts formed integrally with said plurality of key tops, said extruded parts being made of a thermoplastic elastomer;

a U-shaped bridging member connecting said plurality of extruded parts and said plurality of key tops, said U-shaped bridging member being made of a thermoplastic elastomer and arranged in a bridge plane substantially parallel to said key plane;

a housing, said U-shaped member being connected to said housing.

2. The key switch in accordance with claim 1, wherein:

a U-shape of said U-shaped bridging member is arranged in said bridge plane.

3. The key switch in accordance with claim 2, wherein:

a base of said U-shape is connected to said housing;

ends of legs of said U-shape are connected to said extruded parts.

4. The key switch in accordance with claim 1, wherein:

said U-shaped bridging member connects to two extruded parts.

5. The key switch in accordance with claim 1, further comprising:

decorative layers formed on surfaces of said plurality of key tops.

6. The key switch in accordance with claim 1, wherein:

each of said plurality of key tops are bowl-shaped;

each of said plurality of extruded parts are arranged inside one of said bowl-shaped key tops and have a portion extending away from a respective said key top.

* * * * *